US007540370B2

(12) United States Patent
Hahn

(10) Patent No.: US 7,540,370 B2
(45) Date of Patent: Jun. 2, 2009

(54) DEVICE FOR DELIVERING PACKETS COMPRISING A POURING SPOUT

(75) Inventor: Michael Hahn, Hamburg (DE)

(73) Assignee: Fresenius Kabi Deutschland GmbH, Bad Homburg V.D.H. (DE)

( * ) Notice: Subject to any disclaimer, the term of this patent is extended or adjusted under 35 U.S.C. 154(b) by 315 days.

(21) Appl. No.: 10/597,294

(22) PCT Filed: Jan. 20, 2005

(86) PCT No.: PCT/EP2005/000513

§ 371 (c)(1),
(2), (4) Date: Aug. 23, 2006

(87) PCT Pub. No.: WO2005/068299

PCT Pub. Date: Jul. 28, 2005

(65) Prior Publication Data

US 2008/0230350 A1 Sep. 25, 2008

(30) Foreign Application Priority Data

Jan. 20, 2004 (DE) ..... 10 2004 003 037

(51) Int. Cl.
*B65B 43/46* (2006.01)

(52) U.S. Cl. ..... 198/457.01; 198/459.2; 198/463.2; 198/466.1; 198/468.2; 53/283; 141/313

(58) Field of Classification Search ..... 198/457.01, 198/459.2, 463.2, 466.1, 468.2; 53/283; 141/313

See application file for complete search history.

(56) References Cited

U.S. PATENT DOCUMENTS

| | | | | |
|---|---|---|---|---|
| 3,901,180 | A * | 8/1975 | Allen et al. | 118/679 |
| 4,036,353 | A * | 7/1977 | Suter | 198/803.9 |
| 4,369,570 | A * | 1/1983 | Madden et al. | 29/730 |
| 5,695,041 | A * | 12/1997 | Kouda et al. | 198/459.2 |
| 6,286,568 | B1 | 9/2001 | Araki et al. | |
| 2006/0108197 | A1 * | 5/2006 | Okuyama et al. | 198/396 |

FOREIGN PATENT DOCUMENTS

| | | |
|---|---|---|
| DE | 101 46 487 | 4/2003 |
| EP | 1201546 | 5/2002 |
| EP | 1 344 638 | 9/2003 |
| WO | 01/85544 | 11/2001 |
| WO | 03/024800 | 3/2003 |

* cited by examiner

*Primary Examiner*—Mark A Deuble
(74) *Attorney, Agent, or Firm*—Rankin, Hill & Clark LLP

(57) ABSTRACT

The invention relates to a device which is used to deliver packets (1) comprising a pouring spout (2) to a rotating star-shaped element (3). A guiding rail (4), which co-operates with a pouring spout (2) and which is used to receive the bag in a displaceable manner, is provided with a removal end (8). The aim of the invention is to produce a device wherein delivery is simplified and high clock frequencies are ensured. As a result, an upper slider (7) engages with the bags (1) at the pouring spout (2) in the region of the removal end (8) of the guiding rail (4), and a drive unit (9) displaces the upper slider (7) between a removal position (10) on the removal end (8) of the guiding rail (4) and a delivery position (11) of the orbit of the receiving elements (12) of the star-shaped element (3).

12 Claims, 2 Drawing Sheets

DEVICE FOR DELIVERING PACKETS COMPRISING A POURING SPOUT

Figure 1:
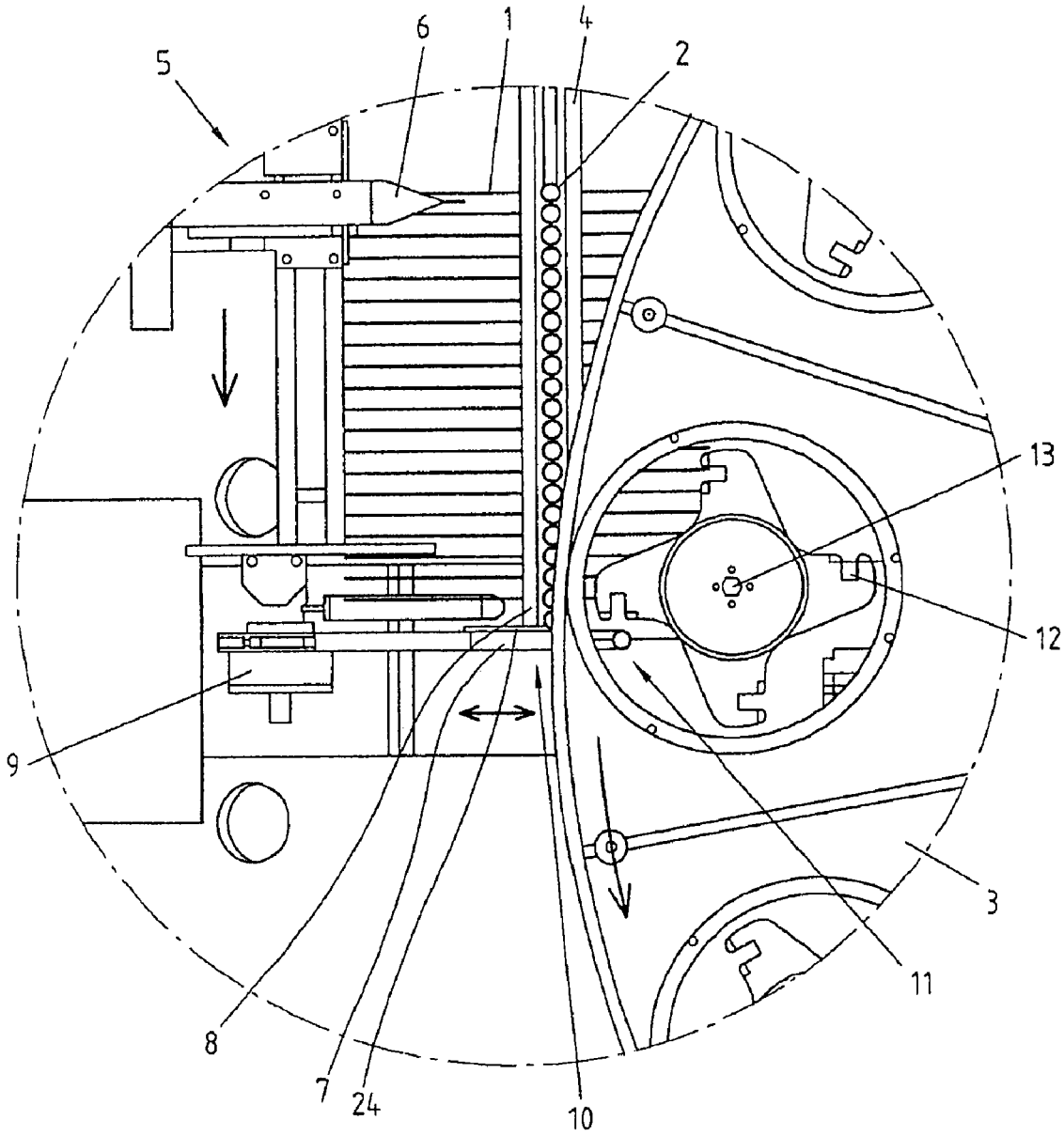

The invention relates to a device for feeding bags having a spout to a star-type reel stand, a guide rail co-operating with the spouts being provided for the moveable holding of the bags and having a removal end.

The bags in question are used as packaging for goods which are free flowing or capable of flowing, i.e. can fill the bags. They are generally made of a multi-layered synthetic composite material. These types of bag are used increasingly as stand-up pouches because due to their flexible outer shell they offer considerable advantages when conveying the full bags and disposing of the empty bags. Dependent upon the application, the bags are produced with or without a spout.

Independently of whether the bags are filled with or without a spout, it is advantageous to feed the bags to one or more star-type reel stands for filling and sealing, as is known from the prior art, in particular for glass and plastic bottles. A system for conveying bags without spouts, which also includes feeding to one or more star-type reel stand/s, is also known for example from PCT-EP 00/04541 which also originates from the applicant.

A system for conveying bags which are provided with a spout is also known, for example, from PCT-EP 02/10483 which also originates from the applicant. However, it is problematic with this apparatus that a complicated pivot mechanism with a separate drive and a separate control is provided which conveys the bags by the spout from a guide rail to a corresponding holding element on the star-type reel stand. A relatively complex design is therefore required in order to make it possible to feed bags.

Starting with the above, the object which forms the basis of this invention is to provide a device for feeding bags having a spout to a star-type reel stand which apparatus simplifies feeding and at the same time guarantees high cycle rates.

According to the invention, the object introduced and indicated above is solved in that an overslide is provided which grips the bags on the spout in the region of the removal end of the guide rail, and a drive which moves the overslide between a removal position on the removal end of the guide rail and a feed position on the circular path of the holding elements of the star-type reel stand.

With the help of this embodiment according to the invention, it is possible to bring the bags with spouts with an increased cycle frequency in comparison to a feed apparatus working with a pivot mechanism into the circular path of the holding elements of the star-type reel stand where these bags are taken from the holding elements of the star-type reel stand from the overslide. It is a substantial advantage here that the mechanism gripping the bags, i.e. the overslide, only has to execute a simple reciprocating movement along its longitudinal axis instead of, as is known from the prior art, a wide pivot movement around at least 90°. As well as an increased cycle frequency, according to the invention a space-saving design is also made possible because the removal end of the guide rail and the feed position on the circular path of the holding elements of the star-type reel stand can lie directly next to one another.

The overslide is preferably provided with an active mechanical gripping mechanism which in particular forms a gap which can be varied in size and with which the bag spouts can be held. The gap can be formed here such that the spout can be gripped in an upper region, in particular in the region of the thread, and a lower region remains free for holding in the corresponding holding element of the star-type reel stand. This applies both for an active and for a passive mechanical gripping mechanism. The active mechanical gripping mechanism makes it possible here for the bags first of all to be gripped on the spout, then to be moved to the feed position on the circular path of the holding elements of the star-type reel stand, and can there be released, the mechanical gripping mechanism actively moving in order to clamp and release the spouts.

Alternatively, provision can also be made such that the gripping mechanism works passively, i.e. has a fixed opening corresponding to the shape of the spout, into which the spout of the bag to be fed can be pressed and held here by friction lock. With the latter solution, the corresponding holding element of the star-type reel stand would have to remove the bag by using force from the fixed opening of the passive gripping mechanism.

In the case of an active mechanical gripping mechanism, the overslide can consist of an upper part with a downwardly pointing end portion, and a lower part which is moveably mounted relative to the upper part, the gap for gripping the spout being formed between the downwardly pointing end portion and the lower part. If the downwardly pointing end portion of the upper part and the lower part are moved towards one another, the spout of a bag can be clamped between both elements. Correspondingly, when both elements are moved away from one another, the spout is released again. Advantageously, the lower part is supported on a rail here which is securely connected, in particular directly, relative to the upper part.

According to a preferred embodiment provision is made such that the drive, which moves the overslide reciprocatingly, grips onto the lower part of the overslide. Because the lower part is moveably mounted relative to the upper part, as soon as the drive moves the lower part towards the downwardly pointing end portion of the upper part, a spout is automatically clamped and moved without delay to the feed position on the circular path of the holding elements of the star-type reel stand. If the drive then moves the lower part back in the opposite direction, the clamped spout is released again. If the lower part is pulled back further, for example against a stop connected to the upper part, by means of the same drive the upper part and so the whole overslide is at the same time moved back into its initial position. In the gap which is then open between the downwardly pointing end portion and the lower part, the next spout can then be introduced from the guide rail. The essential advantage of this variation is therefore that with a single drive, the reciprocating movement of the overslide and at the same time active gripping of the same can be controlled.

According to a further advantageous embodiment, the drive of the overslide is coupled mechanically to the drive or the central axis of the star-type reel stand. In this way, there is no need for a separate motor or a separate control for the drive of the overslide. When there is for example a change to the rotation speed of the star-type reel stand, a corresponding change to the speed of the overslide automatically takes place.

Preferably, the drive of the overslide is designed such that a continuous rotation movement of the central axis of the star-type reel stand is converted into a cyclical reciprocating movement of the overslide, in particular of the lower part of the overslide. The drive can also be designed such that there is a pause between the forth movement of the overslide and the back movement of the overslide. This pause then allows the corresponding holding element of the star-type reel stand a certain time margin for removing the spout from the overslide or the overslide a certain time margin for taking a new spout from the guide rail.

Advantageously, the overslide drive is designed such that the feed apparatus achieves 220 to 280 cycles per minute, and in particular 250 cycles per minute.

Preferably, a double cam is provided, driven by the drive or the central axis of the star-type reel stand, for example by means of a pinion and a chain wheel, which for example co-operates with a rocker by means of a rod, which in turn is also connected for example by a rod to the overslide, in particular to the lower part of the overslide.

According to an advantageous embodiment, the overslide is disposed transversely to the guide rail in which the bags are moveably suspended by their spouts. Of course it is also conceivable to dispose the overslide at an angle to the guide rail. This only depends upon how the release end of the guide rail, the feed position on the star-type reel stand and the guide rail are disposed relative to one another. The shortest feed path and so the highest cycle frequency is achieved, however, by means of a right-angled arrangement of the guide rail and the overslide in relation to one another.

Preferably, the overslide is spaced apart from the removal end of the guide rail by a distance less than a spout width. In this way it is possible for the bags to remain securely on the guide rail and for them not to fall down unintentionally at the removal end of the guide rail. Alternatively or in addition, a pivotable locking element can also be provided which alternatingly opens and closes the guide rail in the working cycle, and in this way forms an additional safety mechanism for protecting the bags from falling unintentionally from the rail.

According to a further advantageous embodiment, a cyclical linear drive is provided which moves the bags in the guide rail towards the overslide. The linear drive preferably comprises a push-in finger which applies pressure to the bags located in the guide rail in the direction of the overslide. The advantage of this is that in the region of the release end of the guide rail, as soon as the gripping mechanism of the overslide is at the height of the guide rail, a new spout is automatically passed to the overslide.

Finally, The device according to the invention for feeding bags with spouts to a star-type reel stand is given an advantageous embodiment in that the star-type reel stand is provided with several inner carrousels.

Figure 2:
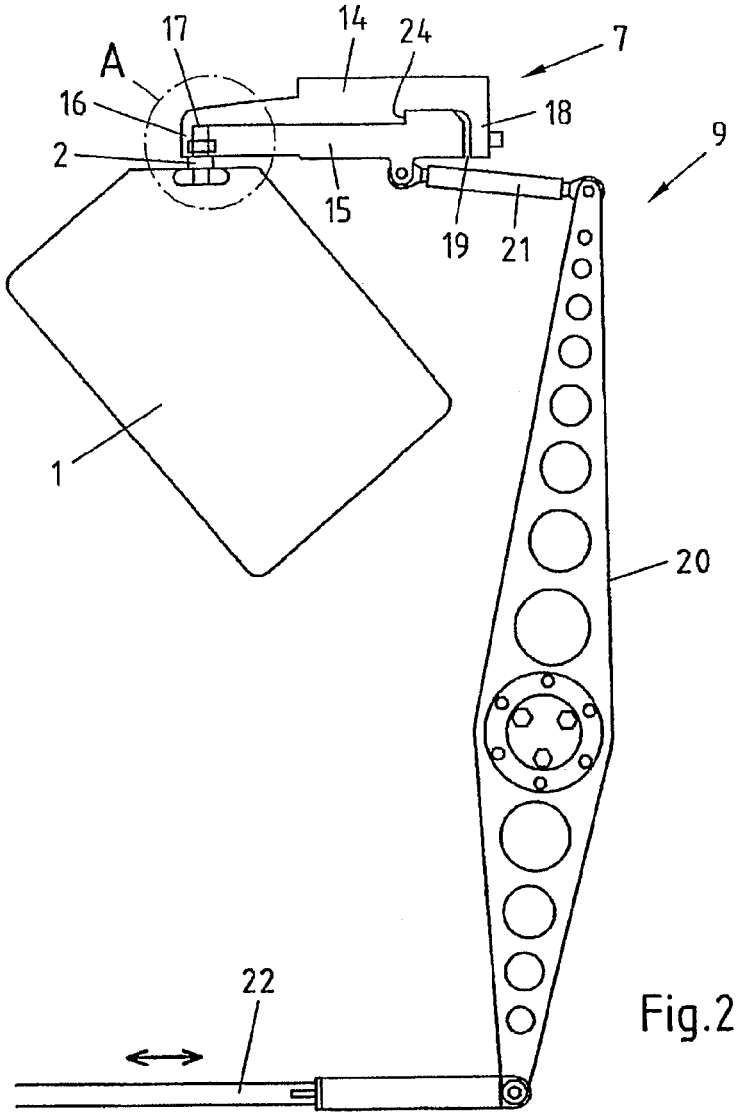
Figure 3:
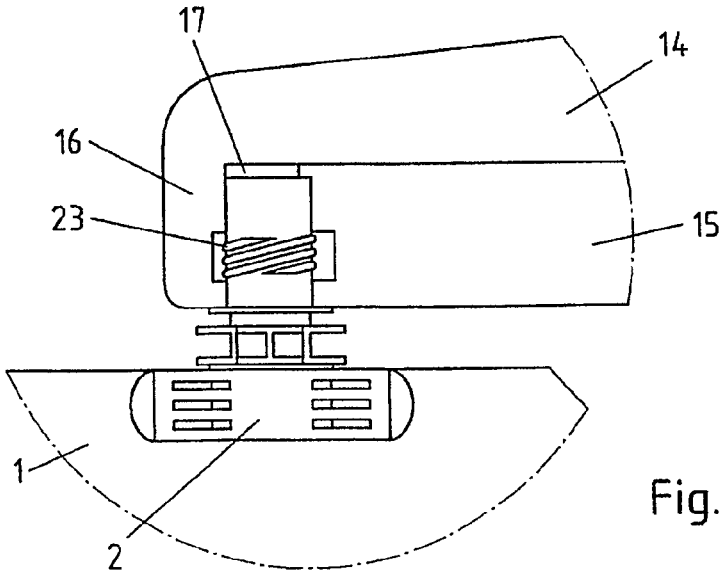

There are a large number of possibilities for designing and further developing the device according to the invention for feeding bags having a spout to a star-type reel stand. With regard to this, reference is made for example on the one hand to the patent claims subordinate to Patent claim 1, and on the other hand to the description of an example of an embodiment in connection with the drawings. The drawings show as follows:

FIG. 1 a schematic view of an example of an embodiment of a device according to the invention for feeding bags having a spout to a star-type reel stand, FIG. 2 a schematic side view of the example of an embodiment in the region of the overslide, and FIG. 3 an enlarged side detailed view of a spout gripped by the overslide.

The example of an embodiment of a device according to the invention for feeding bags 1 with spouts 2 to a star-type reel stand 3 shown in FIG. 1 has a guide rail 4 co-operating with the spouts 2 for moveably holding the bags 1 in the feed direction indicated. In the region of the guide rail a cyclical linear drive 5 comprising a push-in finger 6 is provided, the push-in finger 6 applying pressure to a plurality of bags 1 located in the guide rail 4 in the feed direction, i.e. towards the overslide 7. The overslide 7, which is disposed transversely to the guide rail 4, grips the bags 1 on the spout 2 in the region of the removal end 8 of the guide rail 4. After it has gripped a bag 1, the overslide 7 is moved by a drive 9 starting from a removal position 10 at the removal end 8 of the guide rail 4 to a feed position 11 on the circular path of the holding elements 12 of the star-type reel stand 3.

In this case, the star-type reel stand 3 is one which has twelve inner carrousels 13 separated by an equal distance from one another around its outer circumference, each of these inner carrousels 13, which rotate themselves, having four holding elements 12. Each of these holding elements 12 respectively takes a bag 1 by its spout 2 from the overslide 7.

With the view shown in FIG. 1, the overslide 7 is shown at the moment when a holding element 12 of the star-type reel stand 3 is grasping a spout 2.

The side view shown in FIG. 2 shows the overslide 7 and its drive 9. The overslide 7 consists of an upper part 14 and a lower part 15 which is moveably mounted relative to the upper part 14. Between a downwardly pointing end portion 16 of the upper part 14 and the lower part 15, a gap 17 is formed in which is located, at the moment shown, the spout 2 of a bag 1. On the rear part of the overslide 7 there is a stop 18 for the lower part 15. At this time, i.e. when a bag is being gripped, another gap 19 is provided between the lower part 15 and the stop 18. The gap 19 is of proportions such that when the lower part 15 is moved to the right towards the stop 18, the spout 2 of the bag 1 is released.

The lower part 15, and so the whole overslide 7, is moved reciprocatingly by the drive 9, the drive 9 comprising a rocker 20 which is connected at its upper end by a rod 21 to the lower part 15 of the overslide 7. At its lower end, the rocker 20 is mechanically coupled by a further rod 22 to the central axis (not shown here) of the star-type reel stand. By means of a double cam (not shown either) driven by the central axis of the star-type reel stand, the rod 22 is set in a reciprocating movement which is transferred by the rocker 20 and the rod 21 directly to the lower part 15 of the overslide 7.

The mode of operation is as follows. If the rod 22 moves to the right, the lower part 15 of the overslide 7 is moved by means of the rocker 20 and the rod 21 to the left towards the downwardly pointing end portion 16 of the upper part 14, between the lower part 15 and the downwardly pointing end portion 16 a spout 2 of a bag 1 being clamped.

This state is shown, enlarged, in a schematic detailed view in FIG. 3. The spout 2 is gripped here in an upper region, in fact in the region of the thread 23, a lower region of the spout 2 remaining free so as to be held in the corresponding holding element 12 of the star-type reel stand 3. In the case shown, both the downwardly pointing end portion 16 of the upper part 14 and the lower part 15 have a recess in the region of the thread 23 of the spout 2 so as, in particular, to protect this from damage.

If the rod 22 is now moved further to the right, the lower part 15, by means of the spout 2 and a stop 24, presses the upper part 14 and so the whole overslide 7 to the left. The stop 24, which is formed by a projection in the upper part 14, serves to ensure that not the whole force required to move the overslide 7 onto the upper part 14 by means of the spout 2 is transferred, but that the largest part of the force is absorbed previously by the upper part 14 by means of the stop 24. In this way the spouts are protected as far as possible from being deformed or damaged during the feed process.

As soon as the overslide 7 has been moved so far to the left such that that spout 2 of the bag 1 to be fed is located in the feed position 11, the rod 22 changes its movement of direction. In this way, by means of the rocker 20 and the rod 21, first of all the lower part 15 is moved backwards, closing the gap 19 to the stop 18, the gap 17 widening somewhat in order in this way to release the spout 2. At this moment a holding element 12 of the star-type reel stand 3 will enclose the lower region of the spout 2 and pull the bag 1 out of the overslide 7.

If the rod 22 is moved further backwards, to the left therefore in FIG. 2, by means of the stop 18 the lower part 15 also pushes the upper part 14 and so the whole overslide 7 back into its initial position in which a further bag 1 with a spout 2 is then introduced by the guide rail 4 into the gap 17 which is widened even further. At this time, a new working cycle starts which runs as described above.

With the design according to the invention, the feed apparatus described above achieves a cycle frequency of between 220 and 280 cycles per minute, and in particular 250 cycles per minute.

The invention claimed is:

1. A device for feeding bags (1) having a spout (2) to a carousel, a guide rail (4) cooperating with the spouts (2) being provided for moveably holding the bags (1) and having a removal end (8), wherein an overslide (7) is provided which grips the bags (1) on the spout (2) in the region of the removal end (8) of the guide rail (4), and a drive (9) which moves the overslide (7) between a removal position (10) on the removal end (8) of the guide rail (4) and a feed position (11) on a circular path of holding elements (12) of the carousel (3), wherein the overslide (7) is disposed transversly and in a plane paralell to the guide rail (4).

2. The device according to claim 1, wherein the overslide (7) has an active mechanical gripping mechanism.

3. The device according to claim 2, wherein the gripping mechanism forms a gap (17) which can be varied in size for holding the spout (2).

4. The device according to claim 3, wherein the overslide (7) has an upper part (14) with a downwardly pointing end portion (16) and a lower part moveably mounted relative to the upper part (14), the gap (17) being formed between the downwardly pointing end portion (16) and a lower part (15).

5. The device according to claim 4, wherein the lower part (15) is mounted on a rail which is fixed relative to the upper part (14).

6. The device according to claim 4, wherein the drive (9) is connected to the lower part (15) of the overslide (7).

7. The device according to claim 3, wherein the gap (17) is formed such that the spout (2) can be gripped in an upper region, in particular in the region of the thread (23), and a lower region for holding in the corresponding holding element (12) of the carousel (3) remains free.

8. The device according to claim 1, wherein the overslide (7) is spaced apart from the removal end (8) of the guide rail (4) by a distance smaller than a spout width.

9. The device according to claim 1, wherein a pivotable locking element is provided on the removal end (8) of the guide rail (4).

10. The device according claim 1, wherein a cyclical linear drive is provided which moves the bags (1) in the guide rail (4) towards the overslide (7).

11. The device according to claim 10, wherein the cyclical linear drive comprises a push-in finger (6) which applies pressure in the direction of the overslide (7) to bags (1) located in the guide rail (4).

12. The device according to claim 1, wherein the carousel (3) has several inner carrousels (13).

* * * * *